US007540784B1

(12) United States Patent
Zhang et al.

(10) Patent No.: US 7,540,784 B1
(45) Date of Patent: Jun. 2, 2009

(54) LOW PROFILE ELECTRICAL CONNECTOR

(75) Inventors: George (Huanyl) Zhang, Irvine, CA (US); Yu Zhu, Shenzhen (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/080,293

(22) Filed: Apr. 2, 2008

(51) Int. Cl.
*H01R 25/00* (2006.01)

(52) U.S. Cl. ..... 439/638; 439/566

(58) Field of Classification Search ..... 439/79–83, 439/562–573, 638, 639
See application file for complete search history.

(56) References Cited

U.S. PATENT DOCUMENTS 6,733,335 B2 * 5/2004 Wu ..... 439/570
6,767,235 B2 * 7/2004 Wu ..... 439/328
7,163,422 B2 1/2007 Amano et al.
7,331,818 B2 * 2/2008 Wu et al. ..... 439/573
D583,325 S * 12/2008 Zhu ..... D13/147
7,465,189 B2 * 12/2008 Marcade et al. ..... 439/567
2006/0052006 A1 * 3/2006 Amano et al. ..... 439/638
2007/0149006 A1 * 6/2007 Wu et al. ..... 439/78
2008/0176426 A1 * 7/2008 Zhu et al. ..... 439/79
2008/0287003 A1 * 11/2008 Zhu ..... 439/329
2008/0318468 A1 * 12/2008 Zhu ..... 439/566

* cited by examiner

*Primary Examiner*—James Harvey
(74) *Attorney, Agent, or Firm*—Wei Te Chung

(57) ABSTRACT

An electrical connector (100) includes an insulated housing (1) and a plurality of contacts (2) assembled to the insulated housing (1). The insulated housing (1) includes a peripheral portion (11) and two tongue portions (12, 13) integrated with the peripheral portion (11), said peripheral portion (11) having a transversal base portion (111) and a pair of guiding portions (112, 113) extending forwardly form opposite ends of the base portion (111), each of the guiding portions (112, 113) defines a guiding passage (1121, 1131) along a longitudinal direction; said tongue portions (12, 13) juxtaposed with one another and extending forwardly from the base portion and further aligning with central sections of the guiding passages (1121, 1131). The contacts have mating portions arranged on panel portions to form mating interfaces.

15 Claims, 6 Drawing Sheets

LOW PROFILE ELECTRICAL CONNECTOR

FIELD OF THE INVENTION

The present invention generally relates to an electrical connector, and more particularly to an ultra low profile electrical connector having a mating portion substantially flush to a printed circuit board on which it is mounted.

DESCRIPTION OF PRIOR ART

Serial Advanced Technology Attachment (SATA) is a computer bus (or interface) primarily designed for transfer of data between a computer and storage devices (like hard disk drives or optical drives). SATA offers performance as high as 3.0 Gbit/sec per device with the current specification. SATA uses only 4 signal lines, allowing for much more compact (and less expensive) cables compared with PATA.

An electrical connector assembly made according to SATA protocol is an important interface between a computer and a storage device. A currently Spec of storage device (Hard Disk Drive, HDD) for a computer is 2.5 inch, and a total size of the electrical connector assembled to the HDD is about 39.24×8.5×4 mm, and a thickness of the mating interface is about 1.23 mm, and a thickness of an opposing connector is about 3.5 mm. However, as a drive to reduce a size of the HDD, resulting in the drive for miniaturization of all components, especially an electrical connectors.

Hence, an electrical connector with ultra low profile is highly desired to overcome the aforementioned problems.

SUMMARY OF THE INVENTION

Accordingly, an object of the present invention is to provide a low profile electrical connector assembly.

In order to achieve the object set forth, an electrical connector in accordance with the present invention comprises an insulated housing including a peripheral portion and two tongue portions integrated with the peripheral portion, said peripheral portion having a transversal base portion and a pair of guiding portions extending forwardly form opposite ends of the base portion, each of the guiding portions defines a guiding passage along a longitudinal direction; said pair of tongue portions juxtaposed with one another and extending forwardly from the base portion and further aligning with central sections of the guiding passages, and a plurality of contacts assembled to the insulated housing, with mating portions thereof arranged on tongue portions to form mating interfaces.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 5:
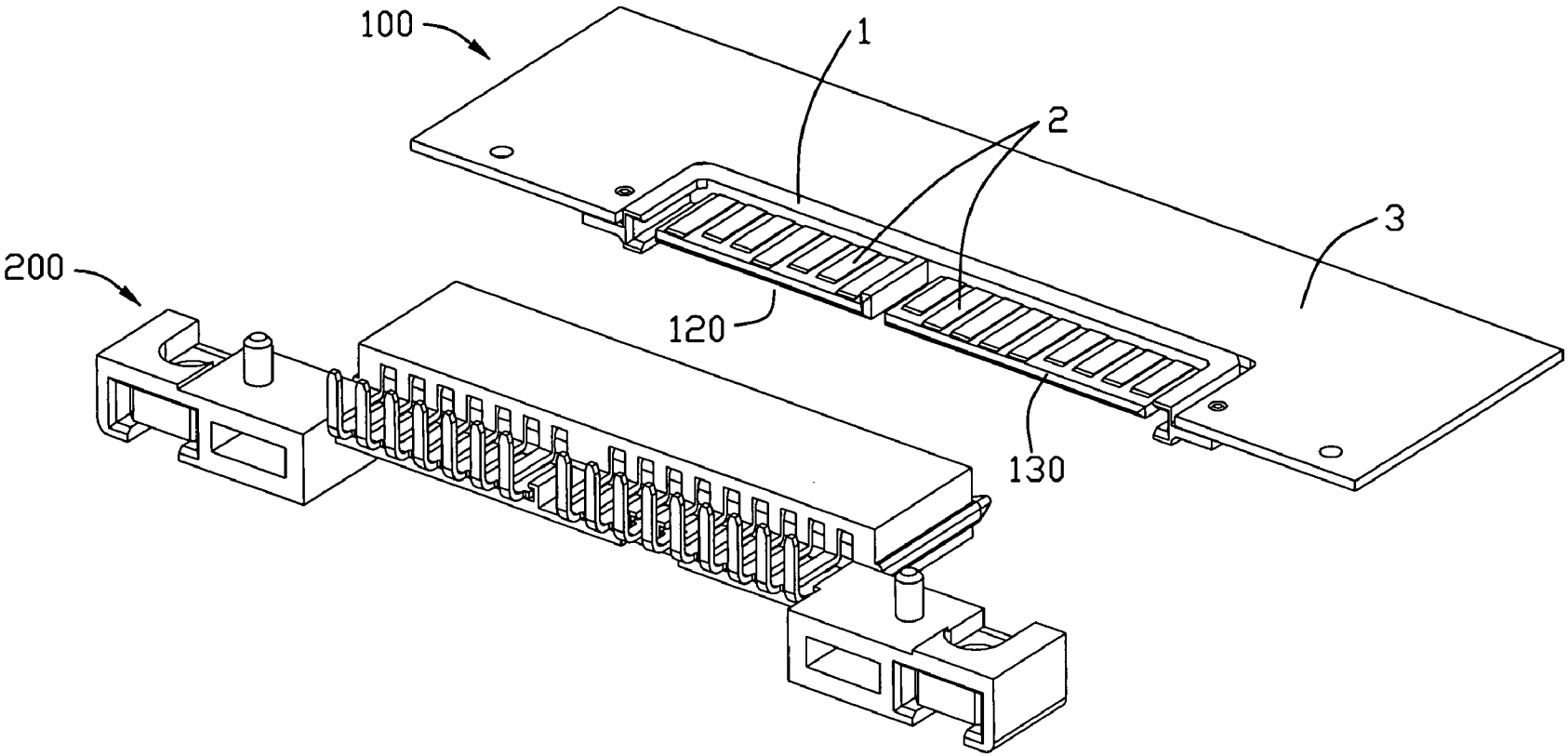
FIG. 5 is an assembled, perspective view of the plug connector and the receptacle connector.
Figure 6:
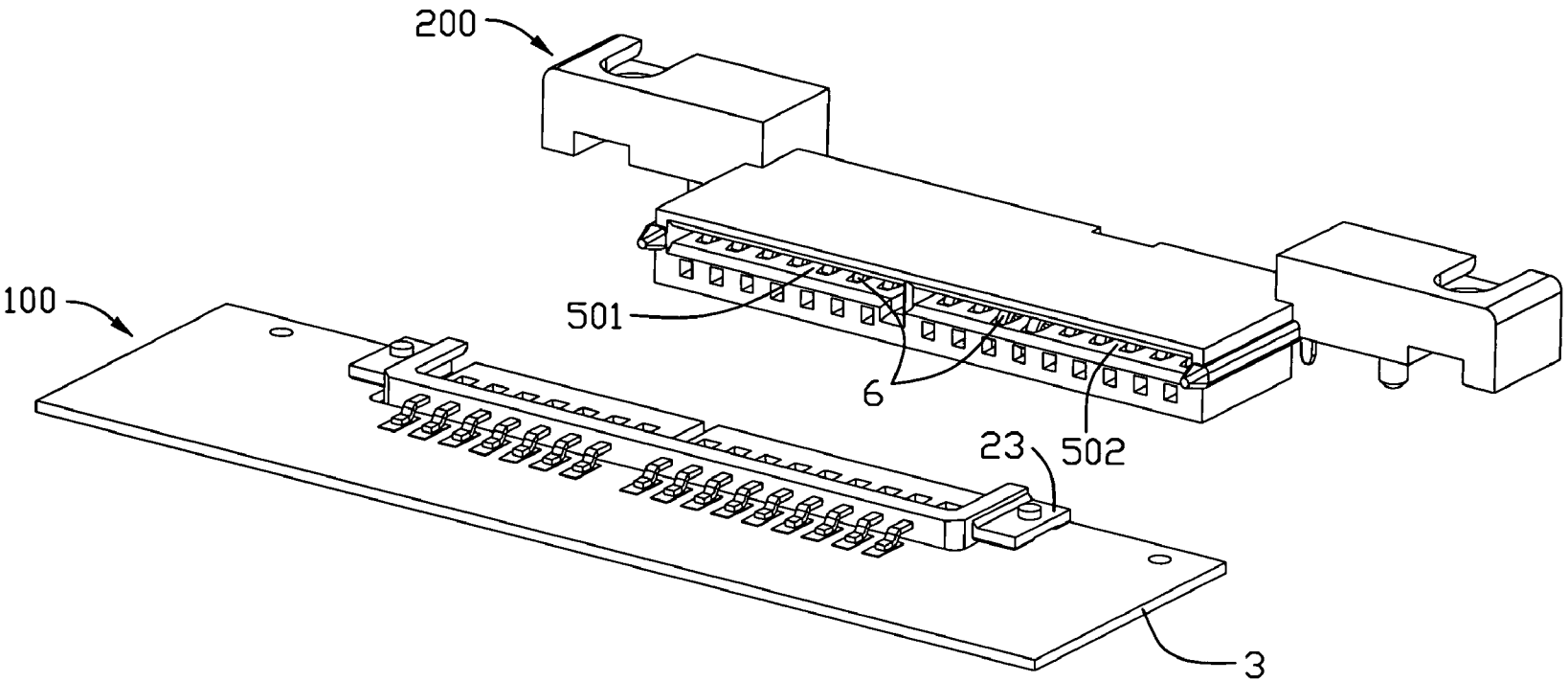
FIG. 6 is similar to FIG. 5, but viewed from another aspect.

Referring to FIGS. 5-6, an electrical interconnection device in accordance with the present invention comprises a plug connector 100 and a receptacle connector 200.

Figure 1:
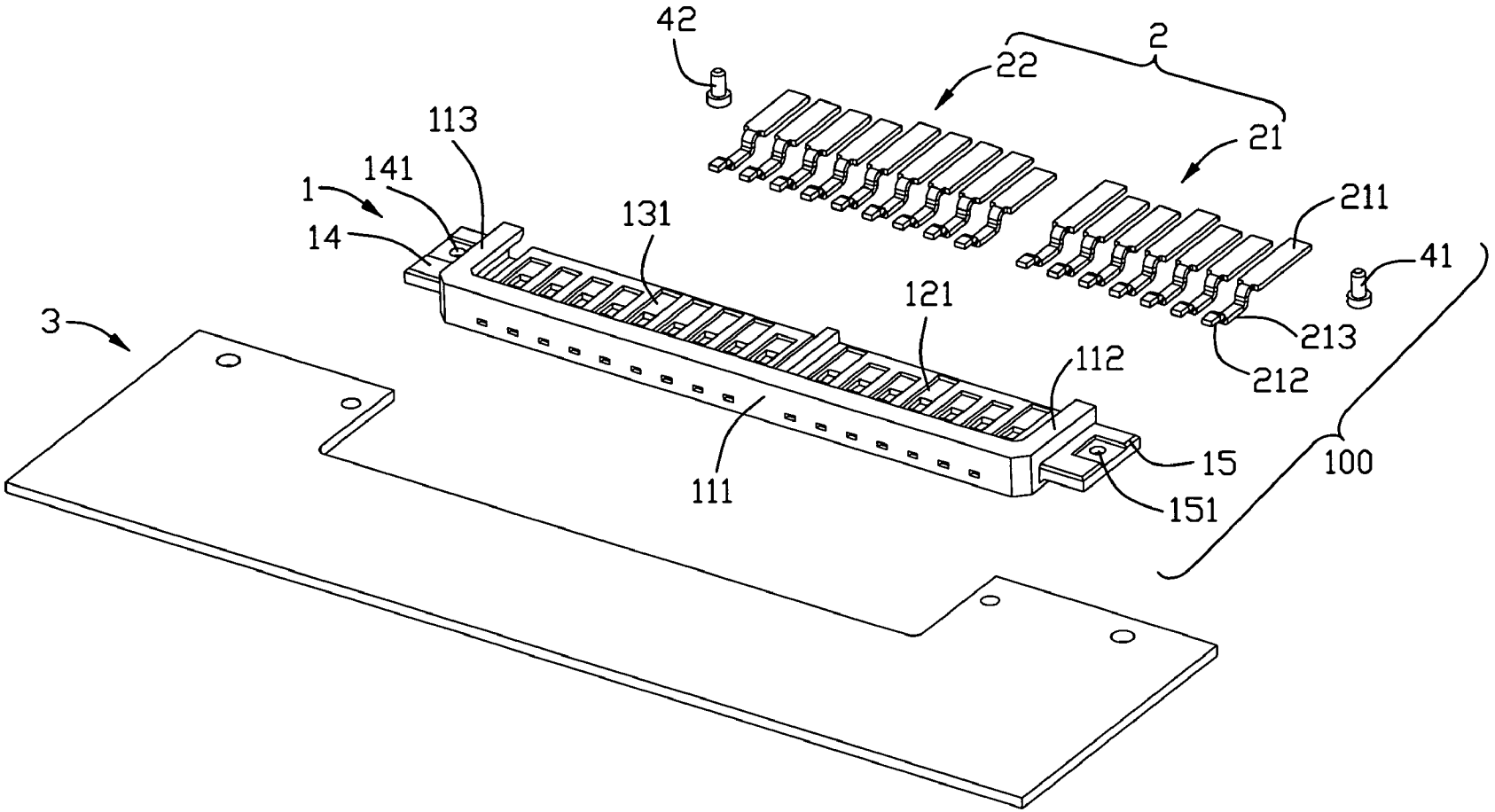
FIG. 1 is an exploded, perspective view of a plug connector in accordance with the present invention.
Figure 2:
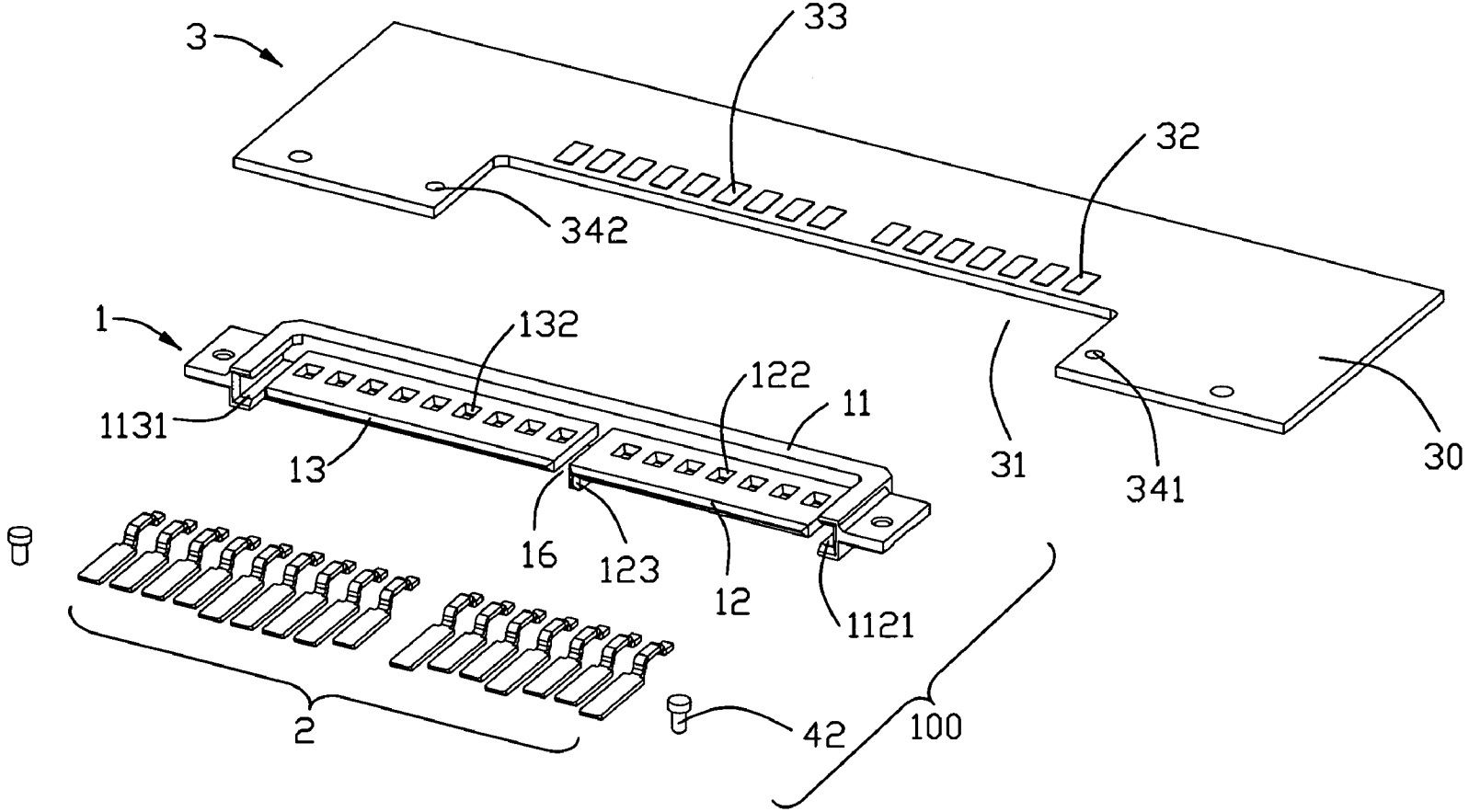
FIG. 2 is similar to FIG. 1, but viewed from another aspect.

Referring to FIGS. 1-2, the plug connector 100 for mounting on a printed circuit board 3 comprises an insulated housing 1 and a plurality of contacts 2 insert-molded with the insulated housing 1.

The insulated housing 1 has a U-shaped peripheral portion 11 and a pair of juxtaposed first and second tongue portions 12, 13 integrated with the peripheral portion 11. The peripheral portion 11 has transversal base portion 111 and two guiding portions 112, 113 extending forwardly from opposite ends of the base portion 111. Each of the guiding portions 112, 113 respectively defines a guiding passage 1121, 1131 along a longitudinal direction. The first and second tongue portions 12, 13 extend forwardly from middle section of a front surface of the base portion 111. The first and second tongue portions 12, 13 further align with central sections of the guiding passages 1121, 1131, along a vertical direction. By this arrangement, the profile of a connector body may be reduced. The first and second tongue portions 12, 13 have a plurality of contact grooves 121, 131 arranged on top sides thereof, respectively. A plurality of windows 122, 132 defined in bottom sides of the first and second tongue portions 12, 13, in communication with the contact grooves 121, 131, respectively, and such design may improve impedance of the connector. A gap 16 is located between the first and second tongue portions 12, 13, and a key 123 is formed on a lateral side of the first tongue portion 12 and adjacent to the gap 16. A pair of mounting portions 14, 15 extends outwardly from outer surfaces of the guiding portions 112, 113, respectively. Each of the mounting portions 14, 15 respectively defines a mounting hole 141, 151.

The contacts 2 are separated into first set contacts 21 and second set contacts 22 along a transversal direction. The first set contacts 21 are assembled to the first tongue portion 12 to form a first mating interface 120 for transmitting signal and the second set contacts 22 are assembled to the second tongue portion 13 to form a second mating interface 130 for transmitting power. Each of the first set contacts 21 includes an expanded mating portion 211 located in the contact groove 121, a retention portion 213 molded with the base portion 111 and a slim tail portion 212 extends outward a back face of the base portion 111. The mating portion 211 and the tail portion 212 are arranged at same imaginary plane. The second set contacts 22 are similar to the first set contacts 21 and assembled to the insulated housing 1 with same manner as these of the first set contacts 21, and detailed description is omitted hereby.

The printed circuit board 3 includes a circuit substrate 30 and a cutout 31 defined in a front segment of the circuit substrate 30. Two group of distinct conductive pads 32, 33 are arranged along a rear edge of the cutout 31. A pair of dowel holes 341, 342 are located in lateral sides of the circuit substrate 30, adjacent to the lateral edges of the cutout 31, either.

The insulated housing 1 is assembled to the printed circuit board 3, with the peripheral portion 11 and a pair of first and second tongue portions 12, 13 received in a cutout 31, the mounting portions 14, 15 seating on the circuit substrate 30 and the mounting hole 141, 151 aligning with through holes 34 of the circuit substrate 30. Then two dowel pins 41, 42 are respectively inserted into dowel holes 341, 342 and mounting holes 141, 151 to fasten the insulated housing 1 to the circuit substrate 30. The tail portions 212 of the contacts 2 are laid on and soldered to the conductive pads 32, 33. The first and second tongue portions 12, 13 further align with the circuit substrate 30 along a horizontal direction. Therefore, the plug connector 100 may occupies merely a small space when assembled to a HDD.

Figure 3:
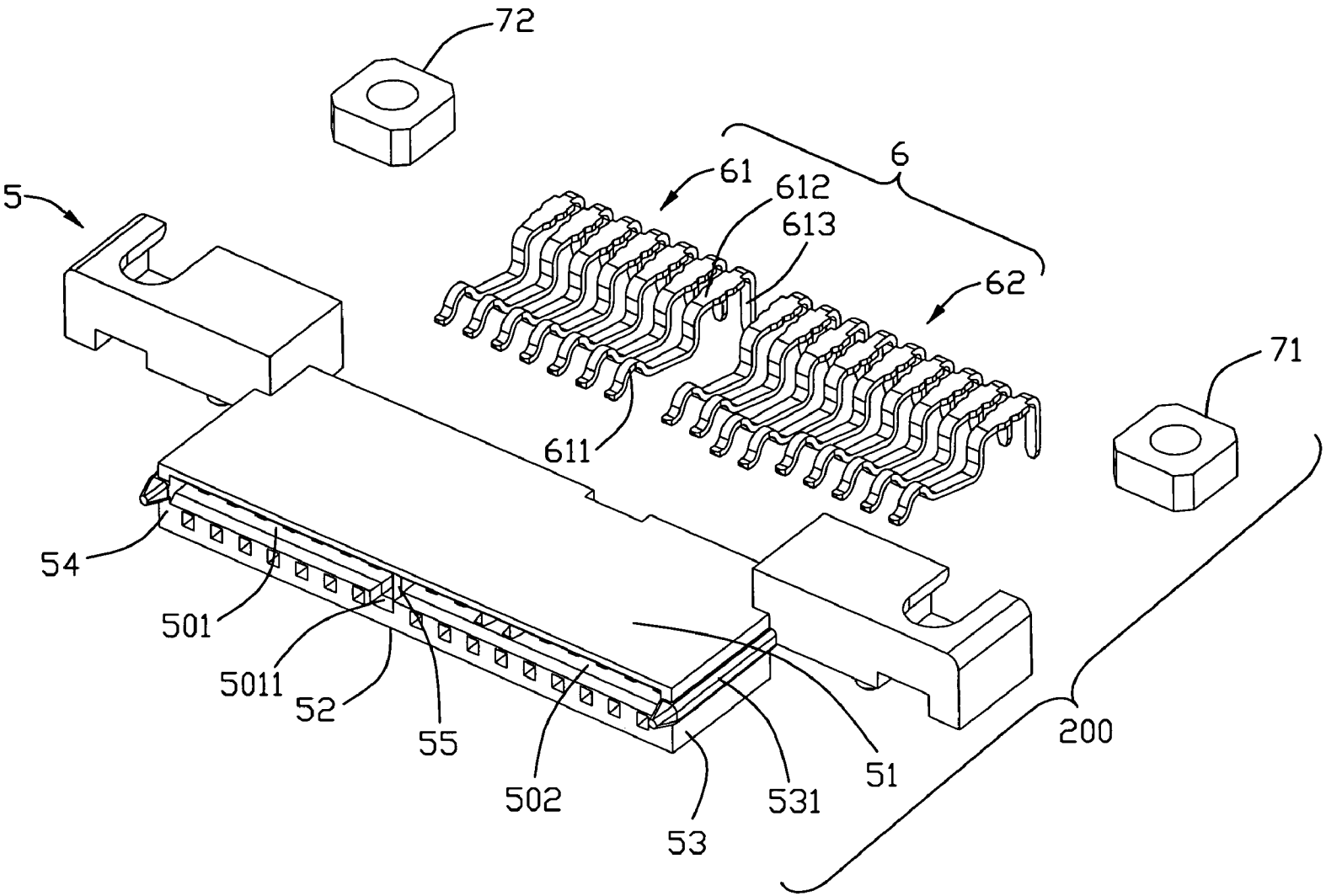
FIG. 3 is an exploded, perspective view of a receptacle connector in accordance with the present invention.
Figure 4:
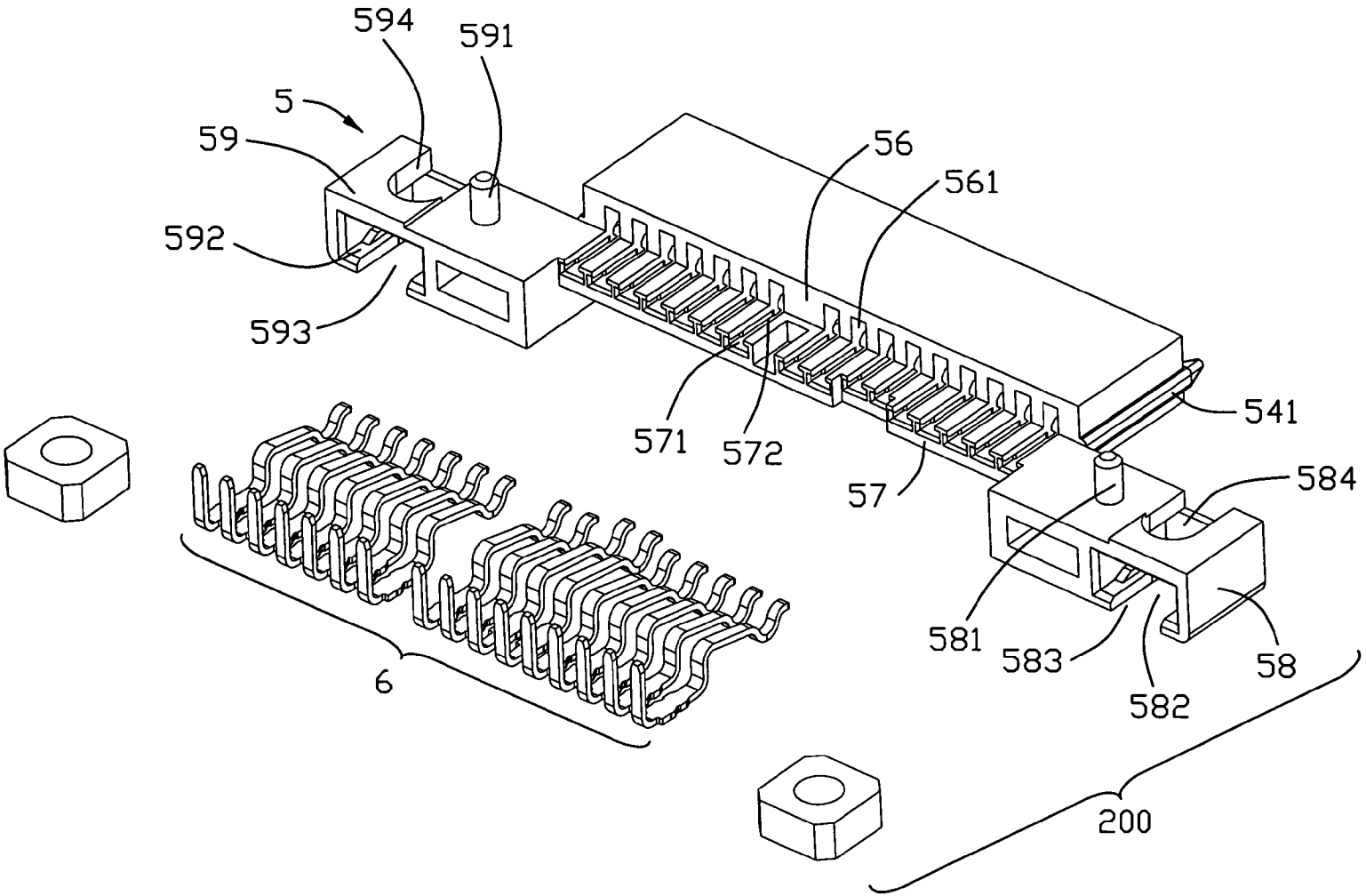
FIG. 4 is similar to FIG. 3, but viewed from another aspect.

Referring to FIGS. 3 and 4, the receptacle connector comprises a dielectric housing 5 and a plurality of terminals 6 associated with the dielectric housing 5. The dielectric housing 5 includes a top wall 51, a bottom wall 52, and a pair of side walls 53, 54 cooperating a hollow portion (not numbered). A spacer 55 divides the hollow portion into a first and second mating port 501, 502. The first mating port 501 is L-shaped, with a keyway 5011 extending along longitudinal direction and adjacent to the spacer 55. The second mating port 502 is rectangular shaped and longer than the first mating port 502 along transversal direction. A pair of guiding posts 531, 541 are respectively formed on outer surfaces of the side walls 53, 54. A rear wall 56 seals back outlet (not shown) of the hollow portion 50, with a number of terminal passages 561 defined therein and communicating with the hollow portion. A supporting member 57 extends rearward from lower surface of the rear wall 56. A number of slots 571 are defined in the supporting member 57 and align with the terminal passages 561 along a front-to-back direction, respectively. A number of slits 572 are defined in a lower portion of the supporting member 57 and communicate with corresponding slots 571. A pair of mounting portions 58, 59 are integrated with lateral sides of the supporting member 57 and further attached to corners of the rear wall 56. A pair of positioning posts 581, 591 extend downward from lower surfaces of the mounting portions 58, 59, respectively. A pair of cavities 582, 592 are defined in the mounting portions 58, 59. A pair of narrower windows 583, 593 are defined in an upper portion of the mounting portions 58, 59 and communicate with the cavities 582, 592. And another pair of outlets 584, 594 are defined in lower portions of the mounting portions 58, 59 and communicate with the cavities 582, 592, either. A pair of nuts 71, 72 are assembled to the pair of cavities 582, 592, respectively.

The terminals 6 are separated into first group terminals 61 and second group terminals 62 along a transversal direction. The first group terminals 61 are used for transmitting signal and the second group terminals 62 are used for transmitting power. Each of the first group terminals 61 includes a curved mating portion 611 extending into the first mating port 501 via the terminal passage 561 of the rear wall 56, a retention portion 612 retained in the slot 571 of the supporting member 57 and tail portion 613 disposed beyond back face of the supporting member 57 and extending downwardly. The second group terminals 62 are similar to the first group terminals 61 and assembled to the dielectric housing 5 with same manner as these of the first group terminals 61, and detailed description is omitted hereby.

When the plug connector 100 mates with the receptacle connector 200, with the guiding posts 531, 541 sliding along the guiding passages 1121, 1131, the first and second mating interfaces 120, 130 of the plug connector plug 100 plug into the first and second mating ports 501, 502 of the receptacle connector 200. The key 123 of the plug connector 100 is inserted into the keyway 5011 of the receptacle connector 200 to ensure proper engagement therebetween. The plug connector 100 is quite compact compared with a common (existing) SATA connector, and a total size is about 30×4.5×1.5 mm, and a thickness of the mating interface is just 0.45 mm. A thickness of the receptacle connector 200 is just 2.72 mm.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical connector adapted for mounting on a printed circuit board, comprising:

an insulated housing including a peripheral portion and two tongue portions integrated with the peripheral portion, said peripheral portion having a transversal base portion and a pair of guiding portions extending forwardly form opposite ends of the base portion, each of the guiding portions defines a guiding passage along a longitudinal direction; said two tongue portions juxtaposed with one another and extending forwardly from the base portion and further aligning with central sections of the guiding passages, and a plurality of contacts assembled to the insulated housing, with mating portions thereof arranged on the tongue portions to form mating interfaces;

wherein the two tongue portions includes first and second tongue portions;

wherein each of the contacts further has a tail portion that is coplanar with the corresponding mating portion thereof, and wherein the first and second tongue portions of the insulated housing align with the printed circuit board along a horizontal direction.

2. The electrical connector assembly as recited in claim 1, wherein the two tongue portions are spaced apart each other by a gap, wherein a key is formed on the first tongue portion and adjacent to the gap.

3. The electrical connector assembly as recited in claim 1, wherein the contacts are insert-molded with the insulated housing, with the mating portions thereof arranged on top sides of the first and second tongue portions.

4. The electrical connector assembly as recited in claim 3, wherein a plurality of windows are defined in bottom sides of the first and second tongue portions and beneath the mating portions of the contacts.

5. An electrical interconnection device, comprising:

a plug connector including:

an insulated housing including a U-shaped peripheral portion and at least a tongue portion integrated with the peripheral portion, the tongue portion extending forwardly from the back side of the peripheral portion and aligning with a central segment of lateral sides of the peripheral portion along a transversal direction, and a number of contacts assembled to the tongue portion to form a mating interface; and a receptacle connector for mating with the plug connector including:

a dielectric housing including a plurality of walls to enclose a hollow portion;

a number of terminals assembled to the dielectric housing and extending into the hollow portion; and wherein the plug connector mates with the receptacle connector, with the mating interface plugging into the hollow portion to form electrical interconnection;

wherein the at least a tongue portion includes first and second tongue portions;

wherein each of the contacts further has a tail portion that is coplanar with a corresponding mating portion thereof, and wherein the first and second tongue portions of the insulated housing align with a printed circuit board along a horizontal direction.

6. The electrical connector assembly as recited in claim 1, wherein the mating portion of the contact is broader than the tail portion thereof.

7. The electrical connector assembly as recited in claim 1, wherein the printed circuit board defines a cutout accommodating the insulated housing.

8. The electrical interconnection device as recited in claim 5, wherein the peripheral portion defines two guiding passage in the lateral sides respectively, wherein a pair of guiding posts formed on side walls of the dielectric housing are capable of sliding along the guiding passages.

9. The electrical connector assembly as recited in claim 1, wherein a pair of mounting portions are formed on outer surfaces of the guiding portions to fasten the insulated housing to the printed circuit board.

10. The electrical interconnection device as recited in claim 5, wherein a keyway is defined in a bottom wall of the dielectric housing and communicates with the hollow portion, wherein a key is formed on the tongue portion and slideable along the keyway.

11. The electrical interconnection device as recited in claim 5, wherein a supporting member extends rearward from back face of the dielectric housing.

12. The electrical interconnection device as recited in claim 11, wherein retention portions of the terminals are retained in slots of the supporting member, respectively.

13. The electrical interconnection device as recited in claim 12, wherein the retention portions of the terminals are partially exposed outside.

14. The electrical interconnection device as recited in claim 11, wherein two mounting portions are arranged at lateral sides of the supporting member.

15. The electrical interconnection device as recited in claim 14, wherein each of the mounting portions defines a cavity, with a nut received in the cavity.

* * * * *